United States Patent [19]

Chen

[11] Patent Number: 5,020,990

[45] Date of Patent: Jun. 4, 1991

[54] GAS FUEL LIGHTER

[75] Inventor: Ming P. Chen, Tainan Hsien, Taiwan

[73] Assignee: First Glorious Enterprise Co., Ltd., Tainan, Taiwan

[21] Appl. No.: 507,431

[22] Filed: Apr. 11, 1990

[51] Int. Cl.[5] ..... F23Q 1/02

[52] U.S. Cl. ..... 431/274; 431/276

[58] Field of Search ..... 431/254, 144, 146, 274, 431/276, 277

[56] References Cited

U.S. PATENT DOCUMENTS

| | | | |
|---|---|---|---|
| 2,677,948 | 5/1954 | Gehrie . | |
| 3,825,401 | 7/1974 | Chevallier | 431/274 |
| 3,827,852 | 8/1974 | Chevallier . | |
| 3,925,004 | 12/1975 | Lauri | 431/254 |
| 4,099,907 | 7/1978 | Fuller | 431/254 |
| 4,146,358 | 5/1979 | Dixon . | |
| 4,315,731 | 2/1982 | Moore . | |
| 4,432,542 | 2/1984 | Poynter | 431/254 |

*Primary Examiner*—Carroll B. Dority

*Attorney, Agent, or Firm*—Varndell Legal Group

[57] ABSTRACT

An improved lighter comprising a resiliently based operating member 71 drivingly coupled to a striker wheel 51 and a control plate 40 for a gas valve 30. The operating member causes the striker wheel to turn against a flint 61 and also presses the control plate downward to release the gas valve for permitting butane gas to escape for ignition. The operating member prevents a finger from coming into direct contact with the striker wheel. A cover is provided above the control plate to protect it from being accidentally displaced.

5 Claims, 6 Drawing Sheets

GAS FUEL LIGHTER

BACKGROUND OF THE INVENTION

A lighter is most useful for a smoker, and numerous kinds of lighters have of course been on the market, both cheap and expensive. Nowadays, there is a growing tendency that inexpensive simple disposable lighters are popular, and the reasons are the following.

1. An expensive lighter is liked by some rich people for its beautiful appearance, but is costly to replace if lost.

2. A can of butane has to be kept at home in order to fill an expensive light when its gas has been used up, and this can be inconvenient.

3. A simple cheap lighter can simply be discarded and replaced after the gas is used up, and if lost by carelessness there is no feeling of serious loss.

Generally speaking, a form of simple lighter in use today, as shown in FIG. 1, comprises a butane well 10 containing butane as the combustible liquid, a gas valve 13 on a base 12 on the upper face of the butane well 10, a gas tube 131 communicating the bottom of the valve 13 with the interior of the butane well 10, a gas adjuster 132 beside the valve 13, a valve opening plate 14 extending to one side of the valve 13, supports 121 extending upwardly from both sides of the base 12, a striker wheel 15 rotatably mounted between the two supports 121, and a flint 16 resiliently urged against the bottom of the striker wheel 15 by means of a spring.

The striker wheel 15 has to be pushed by the user's thumb to rotate and rub against the flint 16 so as to generate sparks. The valve opening plate 14 is pushed down by the thumb at the same time so as to let the gas flow out of the gas valve 13 and be ignited by the sparks. The plate 14 must be kept pushed down to maintain the gas flow from the well 10 whilst the lighter is used. Such an arrangement is advantageously simple, but has the following drawbacks.

1. Fast heat transmission. The thumb is directly exposed to the increasing temperature of the valve opening plate which is made of metal and located very near the striker wheel, and often becomes unacceptably hot causing the user prematurely to release the plate to avoid discomfort.

2. Injury possible. The thumb can be injured whilst rotating the knurl-faced striker wheel 15 which has its underside continuously engaged with the flint 16 and is often quite stiff to rotate.

3. Hard to ignite. Both the striker wheel 15 and the gas opening plate 14 have to be pushed almost simultaneously for successful ignition, and it is awkward to manage to complete both actions at the same time, since the striker wheel 15 is hard to rotate owing to its engagement with the flint and the user's anxiety about injuring the thumb by applying too much force.

4. Inadvertent release of gas. As the gas opening plate 14 is exposed and a lighter is often kept in a pocket, especially a trouser pocket, the plate 14 may be depressed carelessly to allow unignited gas to escape freely from gas well, or may become damaged and not subsequently work properly.

SUMMARY OF THE INVENTION

It is an object of this invention to provide a lighter whereby the drawbacks common with a typical disposable lighter can be overcome. A first drawback of the conventional lighter is the rapid heat transfer from the flame to the user's thumb. The present invention employs an additional pressing body between the thumb and downward pushing arms which open the butane gas valve. In this way, the conduction of heat from the flame to the user's thumb is inhibited.

A second flaw the present invention overcomes is the possible injury to the user's thumbs when striking the lighter. The present invention includes a pressing body containing a small projecting ridge which contacts the striker tangentially and turns the striker on the flint. This allows the user to strike the lighter by pressing the thumb on a smooth pressing face, not the jagged, stiffly turning striker wheel.

Further, the present invention provides a lighter which is easier to ignite. The user can simultaneously strike the flint and release the butane gas by depressing a pressing plate. The pressing plate pushes against the downward pushing arms which cause the gas valve to open. The pressing plate also contains a projecting ridge which turns the drive disc and rotates the striker wheel to create the required spark.

By the above aspects of the present invention and those described below, the present invention corrects flaws or disadvantages common to disposable lighters.

Figure 1:
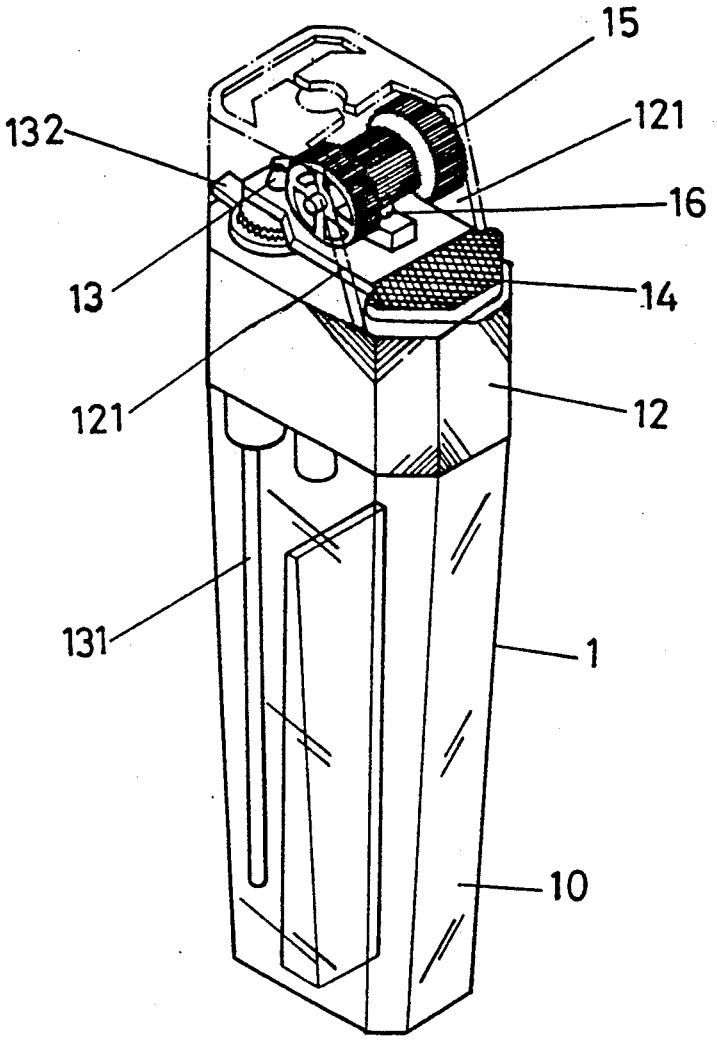
Fig 1 PRIOR ART
FIG. 1 is a perspective view of a conventional simple lighter.

Viewed from one aspect the invention provides a lighter comprising a plastics container defining a gas well communicating with an outlet valve, a component base sealingly secured to the top of the container, the valve being mounted in an aperture formed in the component base, a rotatable striker wheel mounted adjacent the valve between two support members projecting upwardly from the component base, a flint resiliently urged against the striker wheel by means of a spring located in a recess formed in the component base, and an operating member guided so as to be displaceable downwardly with respect to the container against the force of a return spring located in a further recess in the component base, the operating member cooperating with a ratchet like drive wheel coupled to the striker wheel so that the striker wheel may be rotated against the flint to generate ignition sparks by pressing the operating member downwardly, a pivotal control member being mounted on the component base and cooperating with the operating member and with the valve so that further downward movement of the operating member displaces the control member so as to open the valve and permit gas to exit for ignition by the sparks, return movement of the operating member under the force of the return spring causing reverse movement of the control member to close the valve, wherein the valve, the striker wheel and the control member are enclosed by a cover member having a flame aperture above the valve.

Viewed from another aspect the invention provides a lighter comprising:

a case defining a gas well communicating with a gas valve via a tube;

a mechanical component base provided with a gas valve aperture, a flint aperture and an operating member aperture, and two parallel support plates extending upwardly and each having an upwardly open vertical slot for a respective L-shaped locating foot of the operating member to fit and move vertically therein;

a gas valve mounted to the valve aperture of the component base, having its bottom connected with the gas tube extending down into the gas well, and engaging with a flame adjusting member for adjusting the gas flowing via the valve;

a flint having a compression spring mounted in the flint aperture in the component base and engaging with a striker wheel;

a cover provided on one side of the component base and an operating member provided on the other side;

a control plate having its front section cooperating with the outlet of the gas valve and its rear section provided with two downwardly angled arms extending into the operating member aperture and cooperating with the movement of the operating member;

a striker wheel rotatably mounted above the flint aperture between the two support plates, having a knurled circumferential face and a rotatable disc at one side, said disc having ratchet-like projections, said projections being engaged by the end portion of a coil spring of the operating member whereby the striker wheel is turned and rubs against the flint for generating sparks when the operating member is pressed down;

the operating member being mounted to the operating member aperture, and having a displaceable body provided with a pressing face, with a curved and a straight vertical wall extending downwardly and defining a hollow space under the pressing face, said straight vertical wall having two L-shaped feet extending horizontally forwardly so as to engage in the vertical slots in the support plates on the component base as aforesaid and for guiding vertical movement of the operating member, said operating member also being provided with a coil spring and a downwardly projecting rod, said coil spring having a top portion engaged in a curved groove on the underside of the pressing face and extending along a straight groove to a position beneath one of the two L-shaped feet, said rod extending through the spring, and said operating member also being provided with a support bar having a central vertical recess containing the rod and the coil spring and having a top side edge which is located against locating formations provided on the inner side wall of the displaceable body;

said striker wheel being turned upon the disc being rotated by the top end of the coil spring when said operating member is pressed down and thereby the flint is rubbed by said striker wheel to generate sparks as aforesaid, whereafter said control plate is pushed down by the support bar causing the gas valve to release gas by further pressing down of the operating member.

An embodiment of the invention will now be described, by way of example only, with reference to the accompanying drawings.

Figure 2:
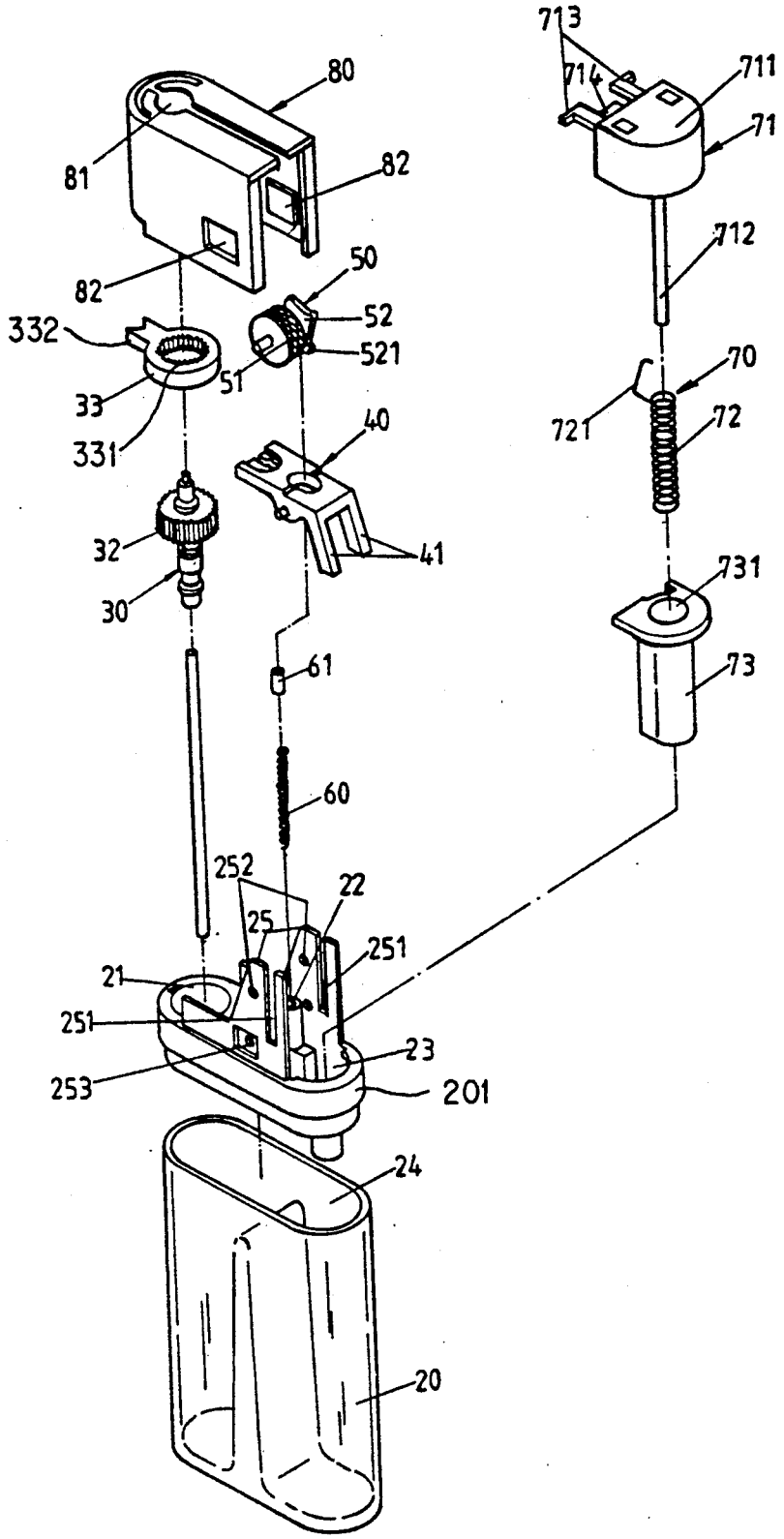
FIG. 2 is an exploded perspective view of an improved lighter in accordance with the present invention.
Figure 3:
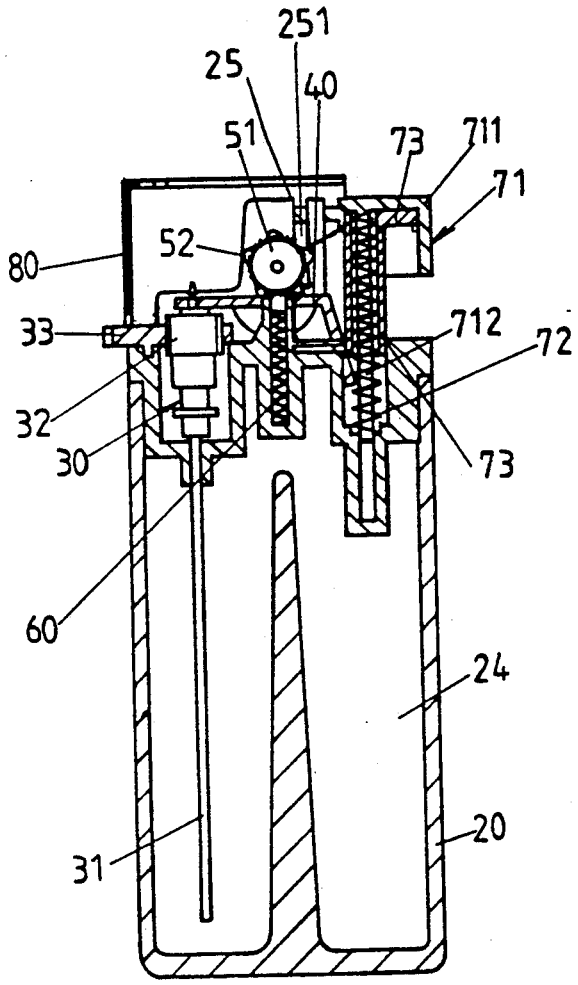
FIG. 3 is a cross-sectional view of the lighter in accordance with the present invention.

First referring to FIGS. 2 and 3, an improved simple lighter in accordance with the present invention comprises a case 20 forming its lower section and a mechanical component base 201 sealingly fixed to the upper opening of the case 20. The mechanical component base 201 is provided with a gas valve aperture 21, a flint aperture 22 and a pressing member aperture 23, the bottom ends of these apertures 21, 22 and 23 being located above a butane well 24 defined by the case 20. The mechanical component base 201 is provided with spaced support plates 25 extending upwards from the sides of the component base 201, the plates having vertical slots 251, through holes 252 and recessed through holes 253.

A gas valve 30 is screw fitted into the gas valve aperture 21 and at its bottom is connected with a gas tube 31 extending down into the butane well 24. A flame adjusting wheel 32 is mounted at the top of the gas valve 30 with an adjusting handle 33 having a round serrated aperture 331 for the flame adjusting wheel 32 to engage in and a projection 332 protruding outward from one side of the component base 201. Thus, by pushing the projection 332 and turning the handle 33 a user can adjust the flow rate of the butane coming out of the valve 30 so as to control the size of flame.

Figure 5:
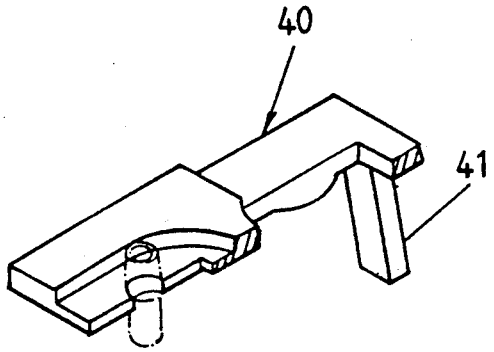
FIG. 5 is an enlarged perspective and partly cross-sectional view of the control plate of the lighter.

A control plate 40 is engaged with the wheel 32, having two parallel downwardly angled pushing arms 41 at its right end (see FIG. 5). A striker wheel 50 is rotatably carried between the support plates 25 by means of a pin extending through the holes 252. The striker is provided with a knurled circumferential face 51 located above the flint aperture 22 and a drive disc 52 fixed adjacent the wheel 50. The drive disc 52 has a plurality of sides and projections 521 acting as ratchet teeth at each corner.

In the flint aperture 2 is located a compression spring 60 for supporting and urging upwardly a flint 61 such that the top of the flint 61 engages the bottom of the knurled face 51 of the striker wheel 50.

Figure 6:
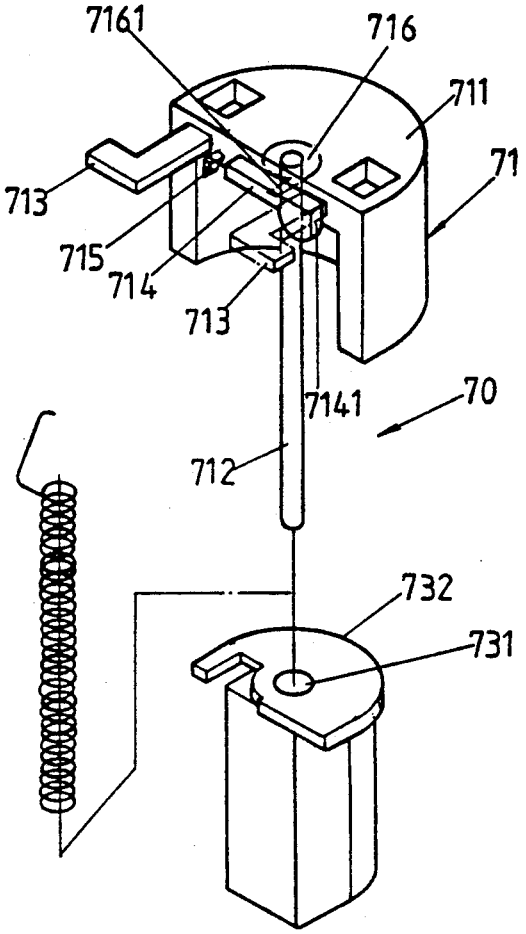
FIG. 6 is an enlarged explosive perspective view of the operating member of the present invention.

A resilient operating or pressing member 70 is located adjacent the upper end of the aperture 23 and comprises a displaceable pressing body 71, a coil spring 72 and a support bar 73. The pressing body 71 is provided with a pressing face 711 at its top and a bar 712 extending down from the underside of the pressing face 711, the bar 712 extending into the spring 72 which in turn extends in a central hole 731 of the support bar 73. The pressing body 71 is also provided with two L-shaped feet 713 extending sideways and engaging with the slots 251 in the support plates 25 so that vertical movement of the pressing body 71 is guided and limited by the slots 251. The pressing body 71 is also provided with a projecting ridge 714 (FIGS. 6 and 7) having a curved side 7141 and two projections 715 on the inner side wall of the pressing body 71 arranged so that the curved edge 732 of the support bar 73 is located securely beneath pressing face 711.

Figure 7:
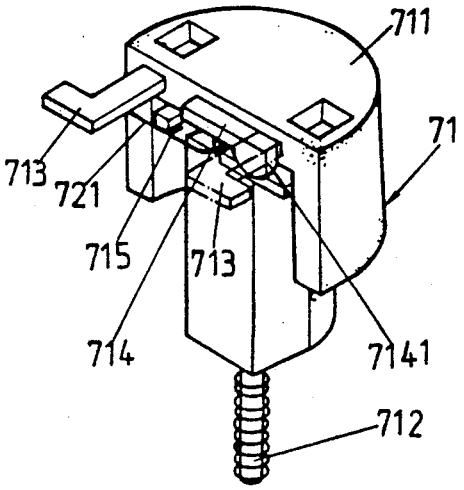
FIG. 7 is a perspective view of the displaceable body of the lighter.

The coil spring 72 has its top end 721 bent so as to engage the striker wheel 50. The bar 712 extends through the spring 72, the top end of which extends along a curved groove 716 of the pressing body 71, and also along a straight groove 7161 extending from the groove 716 to the front of the pressing body 71. The tip of the spring rests against the underside of one of the two L-shaped feet 713 as shown in FIG. 7 after the pressing body 71, the spring 72 and the support bar 73 have been assembled together Therefore, when the bent top end 721 is pressed down or released by the pressing body 71, it hooks and moves the moving disc 52 beside the striker wheel 50, which is also rotated so as to rub against the flint 61.

Figure 4:
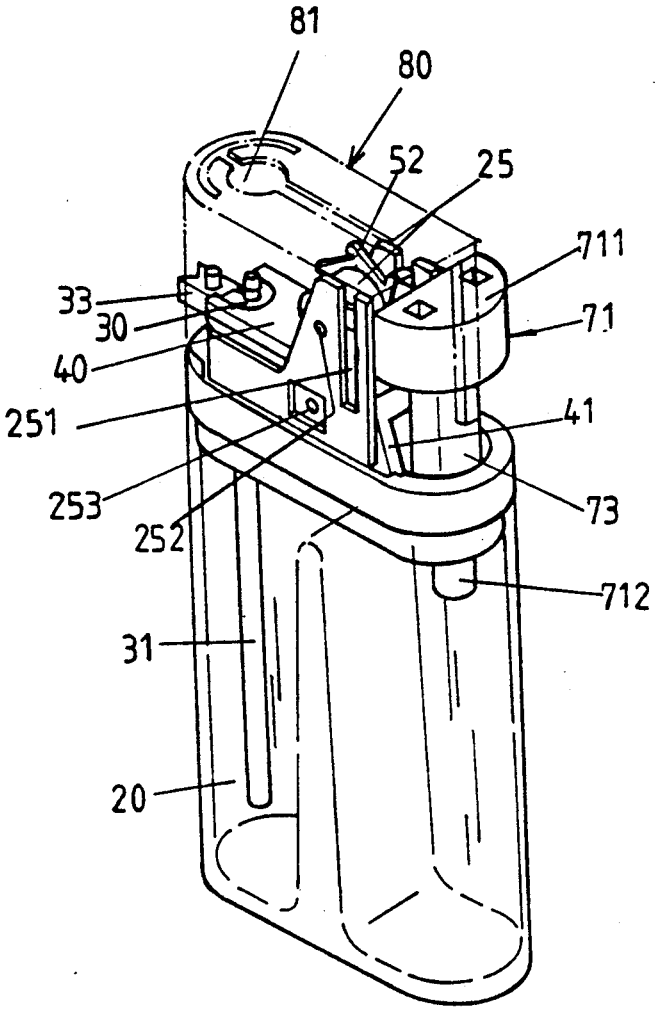
FIG. 4 is a perspective view of the lighter in accordance with the present invention.

A top cover 80 is provided having an opening 81 above the gas valve 30 and, at each of its side walls, a projection 82 corresponding to the respective recessed holes 253 in the support plates 25 so that the cover 80 can be firmly assembled to the support plates 25. The cover 80 has its right end open, the underside of this end contacting the top face of the pressing body 71. FIGS. 3 and 4 shows the lighter completely assembled together. As described above, when the pressing body 71 is depressed, it moves down along the slots 251 in the support plates 25, compressing the spring 72 and causing its top end 721 to pull down one of the projections 521 of the disc 52 so that the striker wheel 50 is turned to rub against the flint 61 thereby generating sparks. Then, if the body 71 is pressed down further, (and the striker wheel 50 also rotated further) the support bar 73 will engage and tilt the arms 41 of the control plate 40, so that the other end of the plate 40 is levered upwardly whereby the gas valve is opened permitting the butane gas to flow out to be ignited by the sparks. After the lighter has been used to light a cigarette, for example, and the body 71 is released, it will recover its normal position under the resilient force of the spring 72 and the rotatable disc 52 will be ready for a further strike.

As can be understood from the above description, a user's finger does not directly touch the control plate 40 or the striker wheel 50 in using this lighter. Therefore, the shortcomings of conventional simple lighters such as fast heat transmission, injury to fingers, etc are avoided with the illustrated lighter, which is safer and more convenient to use.

What is claimed is:

1. A lighter comprising:

a case defining a gas well;

a base mounted on the case and having a gas valve aperture, a flint aperture, an operating member aperture, and two parallel support plates extending upwardly each having a vertical slot;

a gas valve mounted in the valve aperture of the base, having its bottom connected with a gas tube extending down into the gas well, and engaging a flame adjusting wheel mounted thereon for adjusting an amount of gas flowing through the valve;

a flint having a compression spring mounted in the flint aperture of the base and engaging a striker wheel;

a cover enclosing one side of the base and an operating member arranged on another side of the base within the operating member aperture;

the operating member including a displaceable body, the displaceable body having an upper pressing face, and a curved vertical wall and a straight vertical wall each extending downward from the pressing face defining a hollow space below the pressing surface, the straight vertical wall having two L-shaped feet extending horizontally and inwardly and engaging the vertical slots of the two parallel support plates of the base for guiding vertical movement of the operating member, the operating member also including a coil spring and a downwardly extending rod, the coil spring having a top portion engaging a curved groove on an underside of the pressing face and extending along a straight groove to a position beneath one of the two L-shaped feet, the rod extending within the spring, the operating member further including a support bar having a central vertical recess containing the rod and the coil spring and having a top side edge abutting an inner wall of the displaceable body;

the striker wheel rotatably mounted above the flint aperture between the two parallel support plates, having a curved circumferential face and a rotatable disc at one side, the disc having ratchet-like projections, the projections being engaged by an end portion of the coil spring of the operating member so that the striker wheel turns and rubs against the flint for generating sparks when the operating member is initially pressed downward; and a control plate having its front section cooperating with an outlet of the gas valve and two downwardly angled arms on its rear section extending into the operating member aperture and cooperating with movement of the operating member, so that downward movement of the support bar causes the gas valve to release gas when the operating member is pressed further downward.

2. A lighter as claimed in claim 1, wherein the rotatable disc is multi-sided and has a projection at each corner.

3. A lighter as claimed in claim 1, wherein the coil spring has its end portion arranged at a top of the displaceable body.

4. A lighter as claimed in claim 1, wherein the control plate has two parallel arms slanting down into the operating member aperture.

5. A lighter as claimed in claim 1, wherein the two L-shaped feet extend sideways for moving up and down in the vertical slots of the support plate.

* * * * *